US008758176B2

(12) United States Patent
Pedersen

(10) Patent No.: US 8,758,176 B2
(45) Date of Patent: Jun. 24, 2014

(54) BROADHEAD COLLARS

(71) Applicant: Out RAGE, LLC, Proctor, MN (US)

(72) Inventor: William E. Pedersen, Duluth, MN (US)

(73) Assignee: Out RAGE, LLC, Proctor, MN (US)

( * ) Notice: Subject to any disclaimer, the term of this patent is extended or adjusted under 35 U.S.C. 154(b) by 0 days.

(21) Appl. No.: 13/736,680

(22) Filed: Jan. 8, 2013

(65) Prior Publication Data

US 2013/0190112 A1 Jul. 25, 2013

Related U.S. Application Data

(60) Provisional application No. 61/584,430, filed on Jan. 9, 2012.

(51) Int. Cl.
*F42B 6/08* (2006.01)

(52) U.S. Cl.
USPC ..... 473/583

(58) Field of Classification Search
USPC ..... 138/44; 215/310; 473/583, 584
See application file for complete search history.

(56) References Cited

U.S. PATENT DOCUMENTS

| | | | | |
|---|---|---|---|---|
| 4,938,259 | A * | 7/1990 | Schmidt | 138/45 |
| 5,941,784 | A * | 8/1999 | Mizek | 473/584 |
| 6,910,979 | B2 | 6/2005 | Barrie et al. | |
| 8,147,361 | B1 * | 4/2012 | Weaver | 473/583 |
| 8,182,378 | B1 * | 5/2012 | Futtere | 473/583 |
| 8,197,367 | B2 | 6/2012 | Pulkrabek et al. | |
| 8,469,842 | B2 * | 6/2013 | Mizek et al. | 473/583 |
| 2007/0157986 | A1 * | 7/2007 | Lammers | 138/40 |

* cited by examiner

*Primary Examiner* — John Ricci
(74) *Attorney, Agent, or Firm* — Covington & Burling LLP; Gregory S. Discher

(57) ABSTRACT

Collars are provided to facilitate retaining the blades of a broadhead in their in-flight position during flight. Collars can be used in situations where the preexisting use of an O-ring is used to help facilitate maintaining he blades of a broadhead in their in-flight position during flight. Collars can also be used in situations where the preexisting use of an O-ring is not used to help facilitate maintaining he blades of a broadhead in their in-flight position during flight.

23 Claims, 13 Drawing Sheets

BROADHEAD COLLARS

CROSS-REFERENCE TO RELATED APPLICATIONS

This application claims the benefit under 35 U.S.C. §119 (e) of U.S. Provisional Patent Application No. 61/584,430, filed Jan. 9, 2012, herein incorporated by reference in its entirety.

FIELD OF EMBODIMENTS OF THE INVENTION

Embodiments of the present invention generally relate to collars for broadheads, which are also referred to as broadhead arrowtips or arrowheads, and more specifically to blade stabilizing and retaining collars for an expanding broadhead which has an inflight configuration and dimension with the blades retracted and which, upon striking a target, expands the blades outwardly to result in a larger entrance opening in the target.

BACKGROUND OF EMBODIMENTS OF THE INVENTION

There are existing commercially available broadheads that use an O-ring to hold the broadhead blades in their "in flight" position. I have discovered that the O-ring configuration of these broadheads (e.g., 2-blade and 3-blade broadheads) can present reliability issues because the stacking manufacturing tolerances sometimes allow the compression fit between the O-ring and the blades to be insufficient to tightly contain the blades. Accordingly, a broadhead collar is presented herein that can be used in conjunction with broadheads that utilize an O-ring configuration to substantially mitigate or eliminate this problem.

In addition, I have invented a collar for use with a variety of broadheads (e.g., 2-bladed and 3-bladed broadheads) that do not utilize an O-ring. This collar provides substantially the same advantage of the collar that is used in conjunction with an O-ring, and also more tightly contains the blades during flight.

SUMMARY OF EMBODIMENTS OF THE INVENTION

In one embodiment of the present invention, a blade retaining collar for use with an expandable broadhead, is provided. The collar includes a lower annular portion, and an intermediate annular portion that is contiguous with the lower annular portion. The collar also includes an upper annular portion that is contiguous with the intermediate annular portion. The intermediate annular portion has a smaller relative radius than the lower annular portion and the upper annular portion. The upper annular portion has a plurality of slots to allow the "leaves" or sections of the collar to more easily flex outward and/or break during impact with the target.

In another embodiment of the present invention, a blade retaining collar for use with an expandable broadhead is provided. The collar includes an annular shaped external wall and an annular shaped internal wall. In one embodiment, the annular shaped internal wall is adapted to receive an O-ring of the expandable broadhead. A first portion of the external wall and the internal wall includes a plurality of slots to allow the "leaves" or sections of the collar to more easily flex outward and/or break during impact with the target. In one embodiment, the collar can include two or more slots. In another embodiment, the collar can contain three or more slots. In a preferred embodiment, the slots do not receive a blade. Instead, it is preferred that the blades contact the collar in a non-slot position. In another embodiment, the collar is made from a polymeric material, such as polypropylene or polymethylmethacrylate (PMMA).

The blades proximate the tip translate and rotate to a position proximate the base when the expandable broadhead strikes the target. In addition, the cutting edges of the blades are substantially concealed within the slots in the body when in the closed position. Still further, the base includes a threaded shaft that allows the broadhead to be threadably and rotatably mounted in a threaded bore at the front portion of an arrow shaft.

DESCRIPTION OF EMBODIMENTS OF THE INVENTION

Figure 1:
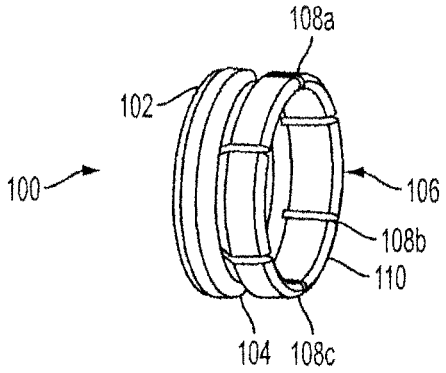
FIG. 1 is an exemplary perspective view of a polymeric version of a broadhead collar.

FIG. 1, generally at 100, is an exemplary perspective view of a polymeric version of a broadhead collar 100. The collar 100 consists of a lower annular portion 102, an intermediate annular portion 104, and an upper annular portion 106. The intermediate annular portion 104 has a smaller relative radius than the lower annular portion and the upper annular portion 106. The upper annular portion 106 has a plurality of slots shown, for example, at 108*a*, 108*b*, 108*c*. In one embodiment, the slots 108*a*, 108*b*, 108*c* extend to an upper portion of the intermediate annular portion 104. A leaf or section 110 is formed between each slot 108*a*, 108*b*, 108*c*. For example, section 110 is shown between slots 108*b* and 108*c*.

Exemplary 2-bladed and 3-bladed broadheads that the collar 100 can be used with can be found, for example, in U.S. Pat. No. 6,910,979, which is incorporated herein by reference herein in its entirety. The collar 100 is designed to break on impact. In a preferred embodiment, the collar is made from poly-methyl-methacrylate (PMMA).

Figure 2:
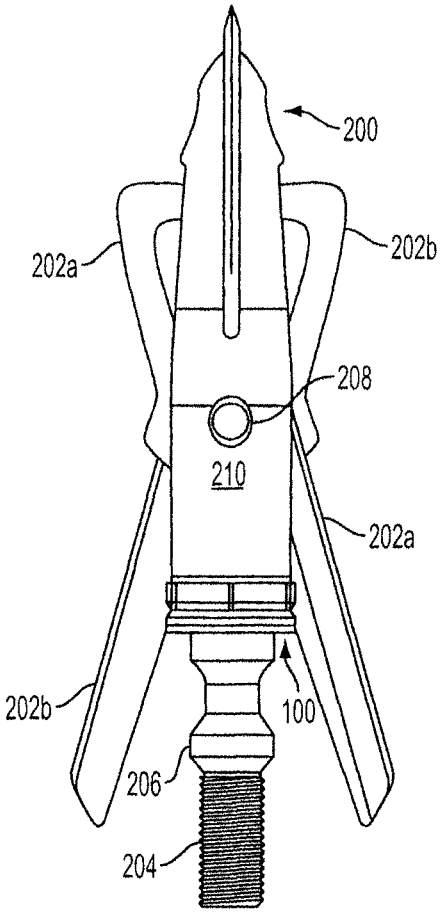
FIG. 2 is an exemplary side view of a 2-bladed broadhead, with a polymeric version of a collar abutting against the broadhead blades.

FIG. 2, generally at 200, is an exemplary side view of a 2-bladed broadhead 200, with a polymeric version of a collar 100 abutting against the broadhead blades. The broadhead 200 can be a conventional 2-bladed broadhead, as disclosed in one or more embodiments of U.S. Pat. No. 6,910,979. The broadhead 200 has a pin 208 or similar element that provides a camming surface and secures the blades 202*a*, 202*b* in position. A passage (shown in FIG. 3, element 302) is formed between or within the front side 210 and the rear side to hold the blades 202*a*, 202*b*. An objective of the collar 100 is to retain the blades 202*a*, 202*b* at the trailing edge of the broadhead 200 until impact, at which point the collar deforms and/or breaks and allows the blades 202*a*, 202*b* to expand outward in a conventional manner.

When the collar 100 is placed on the broadhead 200, the collar 100 is positioned over the threaded portion 204 of the rear arrow shaft attachment end 206. The collar 100 is held in place on an upper portion of the shaft attachment end 206. More particularly, once the broadhead 200 is threaded onto a conventional arrow insert (not shown) that receives and mates with threaded portion 204, the arrow insert holds the collar 100 in place by sandwiching the collar 100 between the broadhead 200 and the arrow insert, as described above. The broadhead 200 contacts upper annular portion 106, and the arrow insert contacts the lower annular portion 102. In this manner, collar 100 is positioned to secure the broadhead blades 202*a*, 202*b*, in place, and retain the blades 202*a*, 202*b* at the trailing edge of the broadhead, such that little movement of the blades 202*a*, 202*b* takes place during flight.

Figure 3:
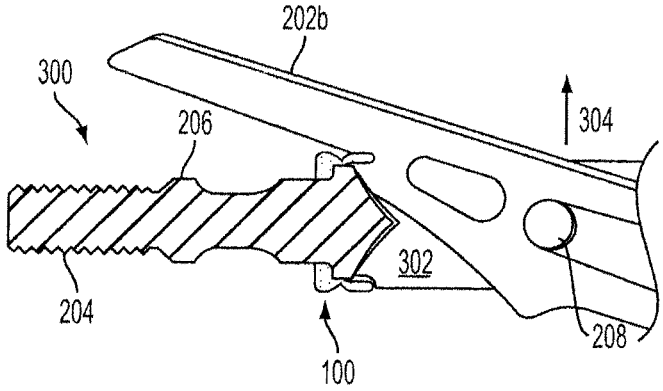
FIG. 3 is an exemplary partial cross section view of a polymeric version of a collar installed on the broadhead of FIG. 2, taken slightly behind centerline of broadhead and looking out of the page.

A depiction showing how the collar 100 mates with a broadhead blade 202*b* and secures the blade 202*b* in place is shown in FIG. 3. Again, it is preferred that the blades 202*a*, 202*b* are not positioned on slots 108*a-c*, but are instead positioned on a non-slotted area of upper annular portion 106.

FIG. 3, generally at 300, is an exemplary partial cross section view of a polymeric version of a collar 100 installed on the broadhead 200 of FIG. 2, taken slightly behind centerline of broadhead and looking out of the page. The collar 100 is positioned over the threaded portion 204 of the rear arrow shaft attachment end 206. The collar 100 is held in place on an upper portion of the shaft attachment end 206, as described above. The blade 202*b* (and blade 202*a*, not shown) is positioned in passage 302. The position of the collar 100, as shown in FIG. 3, secures the broadhead blade 202*b*, in place, and retains the blade 202*b* at the trailing edge of the broadhead. Upon impact, the blade 202*b* will deform and/or break the upper portion of collar 100, thereby allowing the blade to generally move in the direction of arrow 304.

Figure 4:
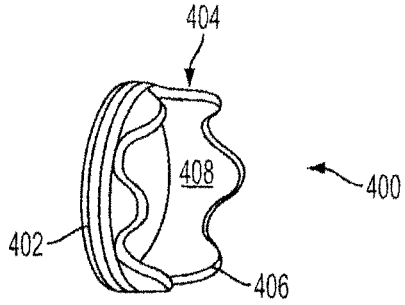
FIG. 4 is an exemplary perspective view of an elastomeric portion of a co-molded broadhead collar.

FIG. 4, generally at 400, is an exemplary perspective view of an elastomeric portion of a co-molded broadhead collar 400. The collar 400 consists of a lower annular portion 402, and an upper annular portion 404. As shown, in a preferred embodiment, the upper surface 406 of the upper annular portion 404 generally has a sinusoidal shape. The upper annular portion 404 also has an internal circular wall 408. The elastomeric portion of co-molded broadhead collar 400 is preferably made of a blend of neoprene, such as Santoprene 291-75B150, 75A Durometer.

Figure 5:
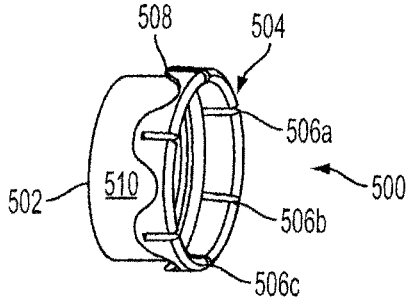
FIG. 5 is an exemplary perspective view of a polymeric portion of a co-molded collar.

FIG. 5, generally at 500, is an exemplary perspective view of a polymeric portion of a co-molded collar 500. The collar 500 consists of a lower annular portion 502 and an upper annular portion 504. The lower annular portion 502 has a smaller radius than the upper annular portion 504, and has an external circular wall 510. The upper annular portion 504 has a plurality of slots shown, for example, at 506*a*, 506*b*, 506*c*. As shown in a preferred embodiment, the lower surface 508 of the upper annular portion 504 generally has a sinusoidal shape, and is made from a material such as RTP 1800 (PMMA).

Figure 6:
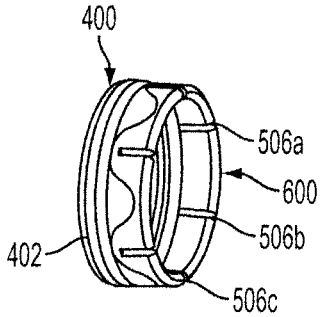
FIG. 6 is an exemplary perspective view of a combined elastomeric portion and polymeric portion of a co-molded collar.

FIG. 6, generally at 600, is an exemplary perspective view of a preferred embodiment of a combined elastomeric portion 400 and polymeric portion 500 of a co-molded collar 600. Physically, that means that lower annular portion 502 will be injection molded as one piece. Then lower annular portion 502 will be inserted into an injection molding die, which is then injected to form assembly 400. Accordingly, the elastomeric portion 402 will not ever exist as an individual piece in the preferred embodiment.

An alternative embodiment is to make the elastomeric portion 402 and lower annular portion 502 as two parts, which are then assembled, and bonded into position. To assemble, the elastomeric portion 400 and the polymeric portion 500 are positioned together as shown in FIG. 6 by bringing the internal circular wall 408 of the elastomeric portion 400 in contact with the external circular wall 510 of the polymeric portion 500. In addition, the upper surface 406 of the upper annular portion 404 generally has a sinusoidal shape that is brought into a fitted mating contact with the lower surface 508 (of the upper annular portion 504), which also generally has a sinusoidal shape.

Figure 7:
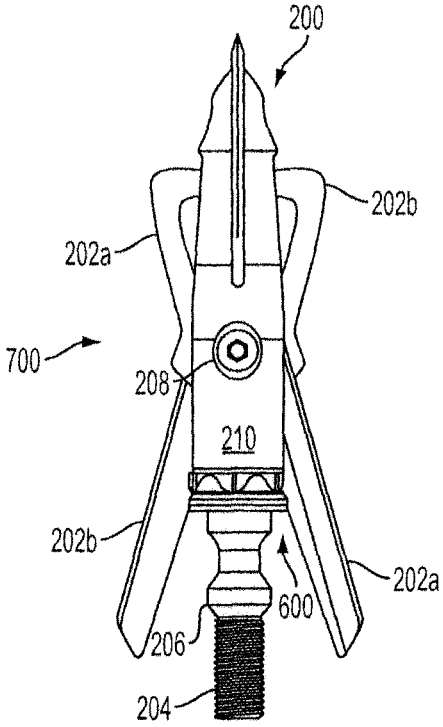
FIG. 7 is an exemplary side view of a 2-bladed broadhead, with a co-molded collar abutting against the blades.

FIG. 7, generally at 700, is an exemplary side view of a 2-bladed broadhead 200, with a co-molded collar 600 abutting against blades 202*a*, 202*b*. FIG. 7 is substantially similar to FIG. 2, except FIG. 7 shows a co-molded collar 600. The objective of the collar 600 is to retain the blades 202*a*, 202*b* at the trailing edge of the broadhead 200 until impact.

Figure 8:
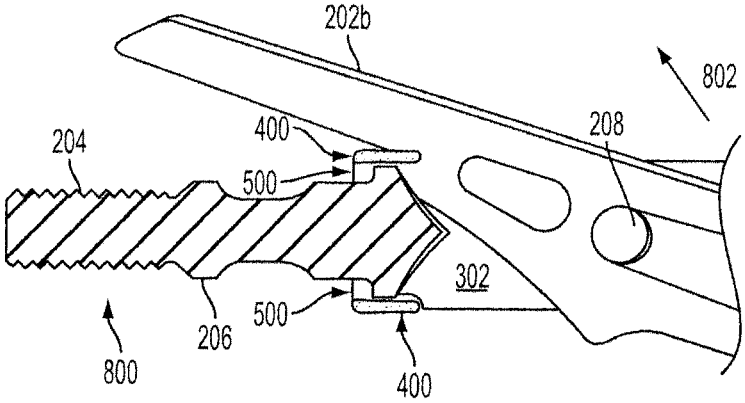
FIG. 8 is a partial cross section view of a combined elastomeric portion and a polymeric portion of a co-molded collar installed on the broadhead of FIG. 7, with cross section taken slightly behind the centerline of the broadhead and looking out of the page.

FIG. 8, generally at 800, is a partial cross section view of a combined elastomeric portion 400 and a polymeric portion 500 of a co-molded collar 600 installed on the broadhead of FIG. 7, with cross section taken slightly behind the centerline of the broadhead and looking out of the page. The collar 600 is positioned over the threaded portion 204 of the rear arrow shaft attachment end 206. The collar 600 is held in place on an upper portion of the shaft attachment end 206 by sandwiching the collar 100 between the broadhead 200 and an arrow insert (not shown). The blade 202*b* is positioned in passage 302. Again, it is preferred that the blades 202*a*, 202*b* are not positioned on slots 108*a-c*, but are instead positioned on a non-slotted area of upper annular portion 504. Upon impact, the blades 202*a* (not shown), 202*b* will break or deform an upper portion of collar 600, thereby allowing, for example, blade 202*b* to generally move in the direction of arrow 802.

Figure 9:
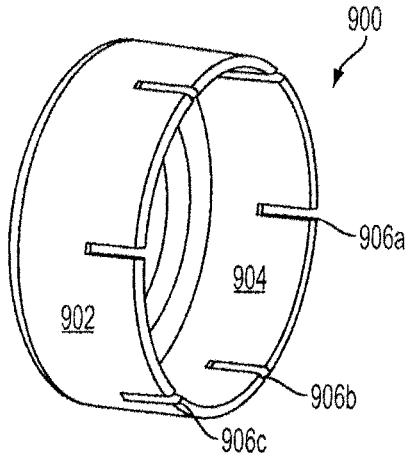
FIG. 9 is an exemplary perspective view of a polymeric version of a collar for use with an O-ring.

FIG. 9, generally at 900, is an exemplary perspective view of a polymeric version of a collar 900 for use with a broadhead that uses an O-ring to maintain the broadhead blades in place. The annular shaped collar 900 has an external circular wall 902 and an internal circular wall 904. The upper annular portion of the collar 900 has a plurality of slots or grooves shown, for example, at 906*a*, 906*b*, 906*c*.

The collar of FIG. 9 is preferably manufactured from a polymeric material (non-elastomer). The material should be flexible enough to withstand normal handling without any breakage issues. Additionally, the material must be flexible enough that it doesn't break when pushed into position by the arrow during assembly. At the same time, the material should be brittle upon impact so that it releases the blade in an impact (rapid loading) situation. The material description of such a material is "strain rate sensitive". A preferred material for the collar of FIG. 9 is polypropylene.

Figure 10:
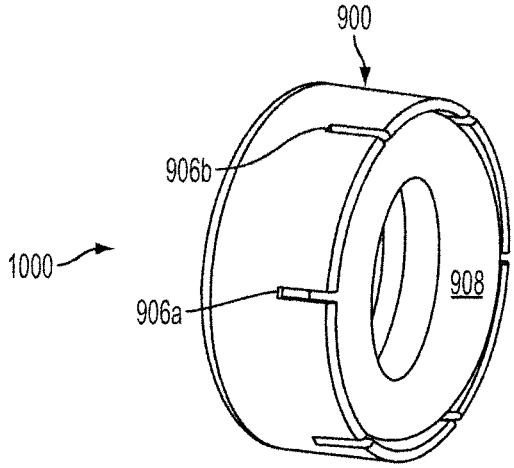
FIGS. 10 is an exemplary perspective view of a polymeric version of a collar that has an O-ring inserted in the collar.

FIG. 10, generally at 1000, is an exemplary perspective view of a polymeric version of a collar 900 that has an O-ring 908 inserted in the collar 900. The external diameter of the O-ring 908 is smaller than internal diameter 904 of the collar 900. In one embodiment, there is a friction fit between the O-ring 908 and the inside curved wall of the collar 900, which has the internal diameter 904.

Figure 11:
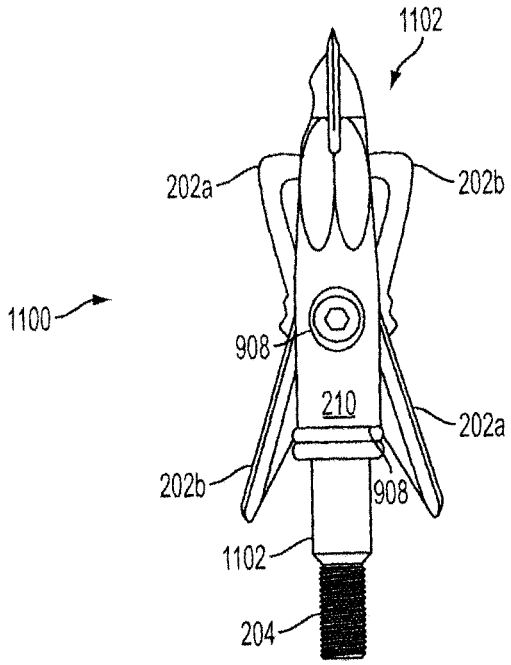
FIG. 11 is an exemplary side view of a 2-bladed broadhead with an O-ring.

FIG. 11, generally at 1100, is an exemplary side view of a 2-bladed broadhead 1102 with an O-ring 908. Broadhead 1102 can be a conventional 2-bladed broadhead, as disclosed, for example, in one or more embodiments of U.S. Pat. No. 6,910,979. The broadhead 1102 has a pin 908 or similar securing means that provides a camming surface and secures the blades 202*a*, 202*b* in position. A passage (as shown, for example, in FIG. 3, element 302) is formed between or within the front side 210 and the rear side to hold the blades 202*a*, 202*b*. The objective of the O-ring 908 is to retain the blades 202*a*, 202*b* in their in-flight position, until the time of impact, and prevent pre-deployment.

Figure 12:
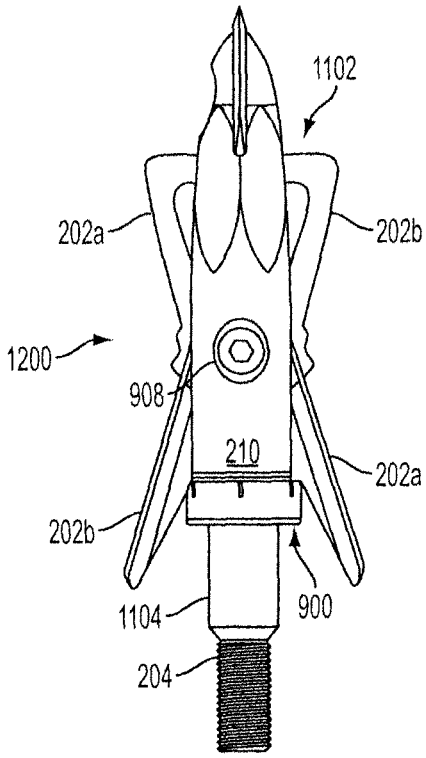
FIG. 12 is an exemplary side view of polymeric version of a collar installed on a 2-bladed broadhead.

FIG. 12, generally at 1200, is an exemplary side view of polymeric version of a collar installed on a 2-bladed broadhead 1102 of FIG. 11. When the collar 900 is placed on the broadhead 1102, the collar 900 is positioned over the threaded portion 204 of the rear arrow shaft attachment end 1104. The collar 900 is held in place on an upper portion of the shaft attachment end 1104 by sandwiching the collar 900 between the broadhead 200 and the arrow insert (not shown). The collar 900 works by pushing the O-ring in and forward (to the leading edge of blades 202*a*, 202*b*) to ensure that it seats solidly against the blades 202*a*, 202*b*. The collar 900 is forced into position as the broadhead 1102 is threaded onto a conventional arrow assembly (not shown). Again, it is preferred that the blades 202*a*, 202*b* are not positioned on slots 906*a-c*, but are instead positioned on a non-slotted area of external circular wall 902.

Figure 13:
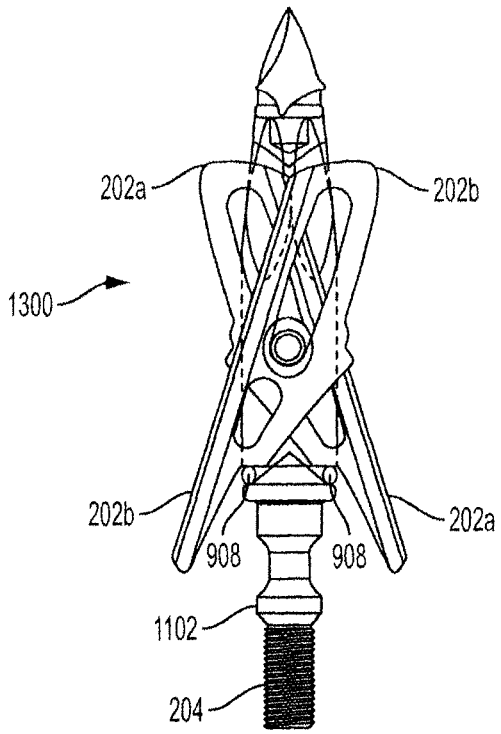
FIG. 13 is an exemplary cross sectional view of 2-bladed broadhead of FIG. 11, taken slightly behind centerline of the broadhead looking out of the page, and showing the blades within the body of the broadhead of FIG. 11.

FIG. 13, generally at 1300, is an exemplary cross sectional view of 2-bladed broadhead 1102 of FIG. 11, taken slightly behind centerline of the broadhead looking out of the page, and showing the blades 202*a*, 202*b* within the body of the broadhead 1102 of FIG. 11. FIG. 13 provides a view of how the O-ring 908 secures the blades 202*a*, 202*b* in place, when collar 900 is not used.

Figure 14:
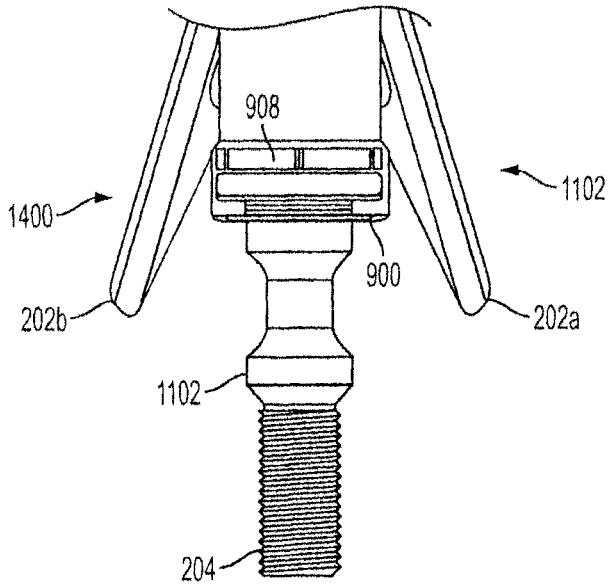
FIG. 14 is an exemplary partial side view of a 2-bladed broadhead with an O-ring within the collar.

FIG. 14 is an exemplary partial side view of a 2-bladed broadhead 1102 with an O-ring 908 within the collar 900. The collar 900 works by pushing the O-ring 900 in and forward to ensure that it seats solidly against the blades 202*a*, 202*b*. The collar 900 is forced into position as the broadhead 1102 is threaded onto a conventional arrow assembly (not shown).

Figure 15:
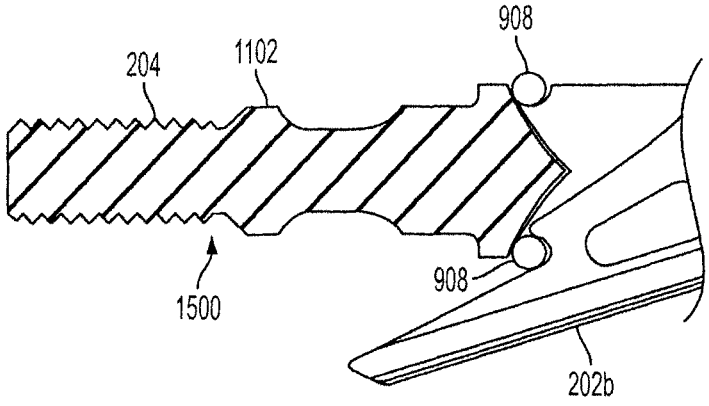
FIG. 15 is an exemplary partial cross sectional view of FIG. 13, with view taken slightly behind the centerline of the broadhead and looking out of the page, showing the O-ring holding the blade in place.

FIG. 15, generally at 1500, is an exemplary partial cross sectional view of FIG. 13, with view taken slightly behind the centerline of the broadhead 1102 and looking out of the page, showing the O-ring 908 holding the blade in place. In certain instances, the stacking manufacturing tolerances sometimes allow the compression fit between the O-ring and the blades to be insufficient to tightly contain the blades 202*a*, 202*b*.

Figure 16:
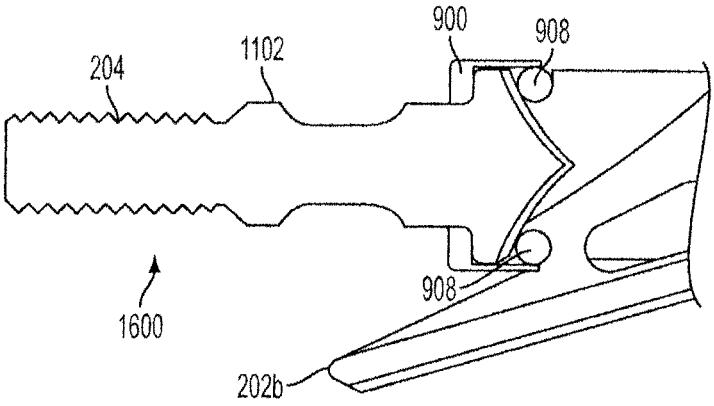
FIG. 16 is an exemplary partial cross sectional view of FIG. 12, showing the polymeric collar of FIG. 9 holding the O-ring and blade in place.

FIG. 16, generally at 1600, is an exemplary partial cross sectional view of FIG. 12, showing the polymeric collar 900 of FIG. 9 holding the O-ring 908 and blade 202*b* in place. The collar 900, when placed over the O-ring 908 and pushed forward (e.g., to the right and towards the tip of the broadhead 1102 when looking in to the page) ensures that the O-ring 908 seats solidly against the blades 202*a*, 202*b*, which substantially mitigates or eliminates this insufficiently tight fit between the O-ring 908 and the blades 202*a*, 202*b* that may occur in FIG. 15 (when a collar 900 is not utilized).

Figure 17:
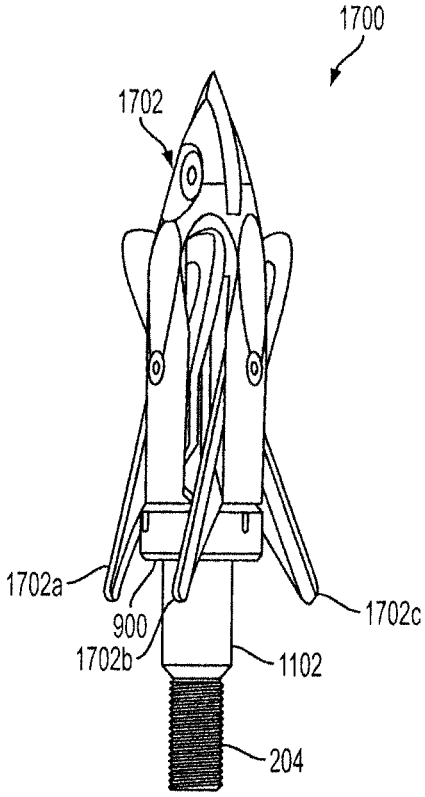
FIG. 17 is an exemplary partial side view of 3-bladed broadhead with a collar and O-ring within collar.

FIG. 17, generally at 1700, is an exemplary partial side view of 3-bladed broadhead 1702 with a collar 900 and O-ring 908 within collar. The operational aspects of the collar 900 and O-ring 908 (not shown) are the same or substantially the same as shown in the 2-bladed embodiment shown in FIGS. 11-16.

Figure 18A:
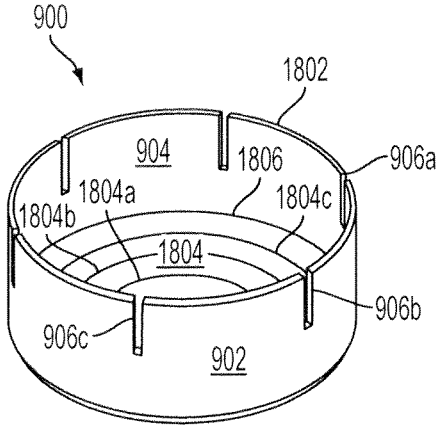
FIG. 18A is an embodiment of the shock collar of FIG. 9, with a stress riser that facilitates the breaking of a portion of the shock collar.

FIG. 18A is an embodiment of the shock collar of FIG. 9, with a stress riser 1806 that facilitates the breaking of a portion of the shock collar 900. The annular shaped collar 900 has an external circular wall 902 and an internal circular wall 904. The upper annular portion of the collar 900 has a plurality of slots or grooves shown, for example, at 906*a*, 906*b*, 906*c*. A lower portion of internal circular wall 904 has an annular portion 1804 that extends inwardly. The inwardly extending portion can be defined by elements 1804*a*, 1804*b*, and 1804*c*, as shown in FIGS. 18A, 18B and 18C.

Figure 18B:
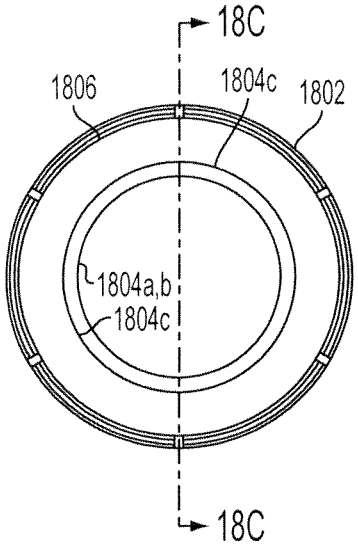
FIG. 18B is a top view of FIG. 18A.

FIG. 18B is a top view of FIG. 18A. A top surface 1802 of external circular wall 902 and internal circular wall 904 is shown in FIGS. 18A, 18B, and 18C.

Figure 18C:
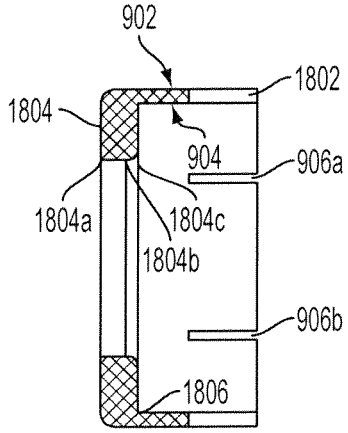
FIG. 18C is a section view of FIG. 18B, taken at line 18C-18C of FIG. 18B.

FIG. 18C is a section view of FIG. 18B, taken at line 18C-18C of FIG. 18B. A stress riser 1806 is preferably formed at an angle of approximately ninety degrees at the juncture of the internal circular wall 904 and a top surface of annular wall 1804. The ninety degree angle provides a maximum stress point that will facilitate breakage of the slots 906*a-c* when the blades of the expandable broadhead are deployed.

Figure 19A:
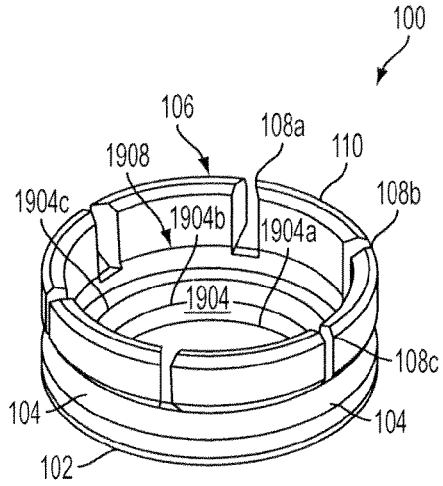
FIG. 19A is an embodiment of the shock collar of FIG. 1, with a stress riser that facilitates the breaking of a portion of the shock collar.
Figure 19B:
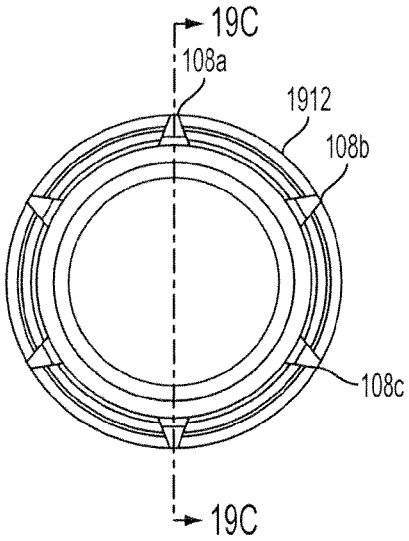
FIG. 19B is a top view of FIG. 19A.
Figure 19C:
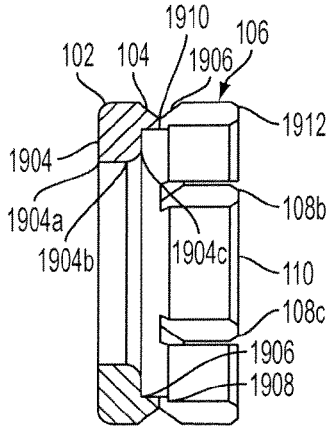
FIG. 19C is a section view of FIG. 19B, taken at line 19C-19C of FIG. 19B.

FIG. 19A is an embodiment of the shock collar 100 of FIG. 1, with a stress riser 1906 that facilitates the breaking of a portion of the shock collar 100. As with the embodiment of FIG. 1, the collar 100 consists of a lower annular portion 102, an intermediate annular portion 104, and an upper annular portion 106. The intermediate annular portion 104 has a smaller relative radius than the lower annular portion. The upper annular portion of the collar 106 has a plurality of slots or grooves shown, for example, at 108*a*, 108*b*, 108*c*. The lower annular portion 102 has an annular portion 1904 that extends inwardly. The inwardly extending portion can be defined by elements 1904*a*, 1904*b*, and 1904*c*, as shown in FIGS. 19A, 19B and 19C. The upper annular portion 106 also has a portion 1906 that, with respect to the top of the shock collar 100, is sloped downwardly and inwardly, towards the center of the shock collar 100. Notch 1910 is a V-shaped groove that is formed at the interface of the intermediate annular portion 104 and the upper annular portion 106.

Intermediate annular portion 104, with respect to the bottom of the shock collar 100, is sloped upwardly and inwardly, towards the center of the shock collar 100. Notch 1908 is a thin groove that preferably extends around the circumference of the inner wall of the upper annular portion 106. The notch 1908 is a mechanism that facilitates breakage of the slots 108*a-c* when the blades of the expandable broadhead are deployed, and may also be thought of a stress riser in this regard, just as element 1906 is a stress riser.

A plurality of slots are shown, for example, at 108*a*, 108*b*, 108*c*. In one embodiment, the slots 108*a*, 108*b*, 108*c* extend to an upper portion of the intermediate annular portion 104. A leaf or section 110 is formed between each slot 108*a*, 108*b*, 108*c*. For example, section 110 is shown between slots 108*a* and 108*b*.

FIG. 19B is a top view of FIG. 19A. A top surface 1912 of the upper annular portion 106 is shown in FIGS. 19B and 19C.

FIG. 19C is a section view of FIG. 19B, taken at line 19C-19C of FIG. 19B. A stress riser 1906 is preferably formed at an angle of approximately ninety degrees at the juncture of the lower annular portion and the intermediate annular portion 104. The ninety degree angle provides a maximum stress point that will facilitate breakage of the slots 906a-c when the blades of the expandable broadhead are deployed.

Stress riser 1906 is formed integral with lower annular portion 102, and intermediate annular portion 104. As shown in FIG. 19C, the stress riser 1906 extends towards the center of the shock collar 100. As shown at 1910. an approximate ninety degree angle is preferably formed within the stress riser 1906 and annular intermediate portion 104. The ninety degree angle creates a maximum stress point and thus provides a second mechanism that facilitates breakage of a section 110 when the blades of the expandable broadhead are deployed.

Embodiments of the present invention have been described for the purpose of illustration. Persons skilled in the art will recognize from this description that the described embodiments are not limiting, and may be practiced with modifications and alterations limited only by the spirit and scope of the appended claims which are intended to cover such modifications and alterations, so as to afford broad protection to the various embodiments of invention and their equivalents.

Having thus described my invention, what I claim as new and desire to secure by Letters Patent is as follows:

1. A blade retaining collar for use with an expandable broadhead, the collar comprising:

a lower annular portion;

an intermediate annular portion contiguous with the lower annular portion, wherein the intermediate annular portion has a smaller relative radius than the lower annular portion;

an upper annular portion continuous with the intermediate annular portion, wherein the upper annular portion comprises a plurality of slots that enable a blade of the expandable broadhead to be positioned between the slots;

wherein the blade deploys and causes at least the upper annular portion to break when the expandable broadhead impacts a target.

2. The blade retaining collar of claim 1, wherein an inner wall of the upper annular portion comprises an annular groove positioned above the plurality of slots.

3. The blade retaining collar of claim 1, wherein the upper annular portion comprises at least three slots and the expandable broadhead comprises at least two blades.

4. The blade retaining collar of claim 3, wherein an inner wall of the upper annular portion comprises an annular groove positioned above the plurality of slots.

5. A blade retaining collar for use with an expandable broadhead, the collar comprising:

a lower annular portion;

an intermediate annular portion contiguous with the lower annular portion, wherein the intermediate annular portion has a smaller relative radius than the lower annular portion;

an upper annular portion continuous with the intermediate annular portion;

wherein the blade deploys and causes at least the upper annular portion to break when the expandable broadhead impacts a target; and wherein the collar comprises at least six slots and the expandable broadhead comprises at least two blades.

6. A blade retaining collar for use with an expandable broadhead, the collar comprising:

a lower annular portion;

an intermediate annular portion contiguous with the lower annular portion, wherein the intermediate annular portion has a smaller relative radius than the lower annular portion;

an upper annular portion continuous with the intermediate annular portion;

wherein the blade deploys and causes at least the upper annular portion to break when the expandable broadhead impacts a target; and wherein the collar is made from a strain rate sensitive polymer material.

7. The blade retaining collar of claim 6, wherein the strain rate sensitive material comprises poly-methyl-methacrylate (PMMA).

8. The blade retaining collar of claim 6, wherein the strain rate sensitive material comprises polypropylene.

9. The blade retaining collar of claim 6, wherein the strain rate sensitive material comprises nylon.

10. A blade retaining collar for use with an expandable broadhead, the collar comprising:

a lower annular portion;

an intermediate annular portion contiguous with the lower annular portion, wherein the intermediate annular portion has a smaller relative radius than the lower annular portion;

an upper annular portion continuous with the intermediate annular portion;

wherein the blade deploys and causes at least the upper annular portion to break when the expandable broadhead impacts a target; and wherein the lower annular portion comprises an annular wall that extend towards the center of the blade retaining collar, and a substantially flat surface of the annular wall forms an approximately ninety degree angle with a substantially flat surface of the intermediate portion positioned closest to the center of the blade retaining collar.

11. A blade retaining collar for use with an expandable broadhead, the collar comprising:

a first piece comprising a first lower annular portion and an second annular portion, the second annular portion comprising a first circular wall and an upper surface comprising a sinusoidal shape;

a second piece comprising a third annular portion and a fourth annular portion, the third annular portion comprising a smaller radius than the fourth annular portion; wherein the third annular portion comprises a second circular wall and a lower surface comprising a sinusoidal shape; and wherein the upper surface comprising a sinusoidal shape and the lower surface comprising a sinusoidal shape mate in physical contact, and the second circular wall fits concentrically within and in substantial contact with a surface of the first circular wall.

12. The blade retaining collar of claim 11, wherein the first piece comprises an elastomeric material.

13. The blade retaining collar of claim 12, wherein the first piece comprises a blend of neoprene.

14. The blade retaining collar of claim 11, wherein the second piece comprises a polymeric material.

15. The blade retaining collar of claim 11, wherein the fourth annular portion comprises a plurality of slots that enable a blade of the expandable broadhead to be positioned between the slots, and wherein the blade deploys and causes at least the fourth annular portion to break when the expandable broadhead impacts a target.

16. The blade retaining collar of claim 11, wherein the second piece comprises a strain rate sensitive polymer material.

17. The blade retaining collar of claim 16, wherein the strain rate sensitive material comprises poly-methyl-methacrylate (PMMA).

18. The blade retaining collar of claim 16, wherein the strain rate sensitive material comprises polypropylene.

19. The blade retaining collar of claim 16, wherein the strain rate sensitive material comprises nylon.

20. A blade retaining collar for use with an expandable broadhead, the collar comprising:

an annular shaped wall comprising a plurality of slots that enable a blade of the expandable broadhead to be positioned between the slots;

an O-ring comprising an external diameter that is smaller than an internal diameter of the annular shaped wall;

wherein a portion of the annular shaped wall and a portion of the O-ring contact a portion of a blade of the expandable broadhead prior to expandable broadhead impacting a target;

wherein the blade deploys and causes at least a portion of the annular shaped wall between two slots to break when the expandable broadhead impacts a target.

21. The blade retaining collar of claim 20, wherein the collar comprises a polymeric material.

22. The blade retaining collar of claim 21, wherein the polymeric material is polypropylene.

23. The blade retaining collar of claim 20, wherein the O-ring is held in place by a friction fit.

* * * * *